US008337255B2

(12) United States Patent
Shamoto

(10) Patent No.: US 8,337,255 B2
(45) Date of Patent: Dec. 25, 2012

(54) CONNECTOR AND SERIES OF CONNECTORS

(75) Inventor: Wataru Shamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 148 days.

(21) Appl. No.: 12/913,201

(22) Filed: Oct. 27, 2010

(65) Prior Publication Data

US 2011/0104921 A1 May 5, 2011

(30) Foreign Application Priority Data

Oct. 29, 2009 (JP) ..... 2009-248996

(51) Int. Cl.
*H01R 13/64* (2006.01)

(52) U.S. Cl. ..... 439/680

(58) Field of Classification Search ..... 439/157, 439/372, 680
See application file for complete search history.

(56) References Cited

U.S. PATENT DOCUMENTS

| | | | | |
|---|---|---|---|---|
| 4,376,565 | A | 3/1983 | Bird et al. | |
| 4,790,763 | A * | 12/1988 | Weber et al. | 439/65 |
| 5,401,179 | A * | 3/1995 | Shinchi et al. | 439/157 |
| 5,709,560 | A * | 1/1998 | Hio | 439/157 |
| 5,865,651 | A | 2/1999 | Dague et al. | |
| 7,513,784 | B2 * | 4/2009 | Shibata | 439/157 |
| 2005/0215106 | A1 * | 9/2005 | Holub | 439/357 |

FOREIGN PATENT DOCUMENTS

JP 2009-163998 7/2009

* cited by examiner

*Primary Examiner* — Renee Luebke
*Assistant Examiner* — Larisa Tsukerman
(74) *Attorney, Agent, or Firm* — Gerald E. Hespos; Michael J. Porco

(57) ABSTRACT

A connector has a housing (10) connectable with a mating housing (40) and projections (21) formed at ends of outer surfaces of the housing (10) with respect to a width direction orthogonal to a connecting direction. A connecting operation of the two housings (10, 40) progresses when the projections (21) are fit into recesses (46) formed in the mating housing (40) while being prevented when the projections (21) cannot fit into the recesses (46). Surfaces of the projections (21) facing a widthwise center of the housing (10) are inclined surfaces (24) inclined outwardly.

12 Claims, 10 Drawing Sheets

CONNECTOR AND SERIES OF CONNECTORS

BACKGROUND OF THE INVENTION

1. Field of the Invention

The invention relates to a connector and to a series of connectors.

2. Description of the Related Art

Japanese Unexamined Patent Publication No. 2009-163998 discloses a connector with a wide rectangular block-shaped housing that is connectable with a mating housing. Rectangular column-shaped projections are formed at four corners of the housing, and recesses are formed at positions on the mating housing corresponding to the projections. The projections fit into the corresponding recesses as the housings are connected. However, the connecting operation is prevented if the respective projections cannot be fit into the corresponding recesses. Therefore, the housings cannot be connected in a wrong combination.

The above-described connector may be displaced in a width direction orthogonal to a connecting direction during insertion into a through hole of a panel. In such cases, the projections may be caught by the edge of the through hole of the panel to hinder a movement of the connector.

The invention was developed based on the above situation and an object thereof is to improve operability in moving a connector.

SUMMARY OF THE INVENTION

The invention relates to a connector with a housing that is connectable with a mating housing along a connecting direction. At least one projection is formed at an end of an outer surface of the housing with respect to a width direction and projects at an angle to the connecting direction and preferably substantially orthogonal to the connecting direction. A connecting operation of the two housings progresses if the projection can fit into a recess in the mating housing. However, connection is prevented if the projection cannot fit into the recess. A surface of the projection facing toward a widthwise center of the housing is inclined outwardly.

An erroneous connection of the two housings is prevented if the projection cannot fit into the recess. Further, any obstacle that may be present in a moving direction of the housing slides on the inclined surface of the projection. Thus, the projection will not be caught on the obstacle, and a moving operation can be performed smoothly. Therefore, operability is improved while moving the connector.

Two projections with inclined surfaces preferably are formed at opposite ends of the housing with respect to the width direction.

The housing may be moved in the width direction while inserting the housing into a through hole of a panel. However, the inclined surface at a rear side of the projection with respect to the inserting direction of the housing smoothly guides the housing into the through hole. Further, the inclined surface at a front side of the projection with respect to the inserting direction of the housing into the through hole smoothly guides the housing when pulling the housing out of the through hole.

An outer edge of the housing preferably has a substantially rectangular shape, and the projections with the inclined surfaces are formed at four corners of the housing. The projections at the four corners of the housing reliably prevent an erroneous connection of the two housings and increase the strength of the housing.

A recess is formed in an inner surface of a tubular receptacle and includes a mating inclined surface corresponding to the inclined surface.

The mating housing preferably has a tubular receptacle with an inner surface that is inclined to correspond to the inclined surface. Thus, a part of the receptacle corresponding to the mating inclined surface becomes thicker and the strength of the receptacle is increased. The housing may be aligned oblique to the mating housing during connection and hence the projection may engage the wall of the receptacle. However, the stronger receptacle will not be subject to a bulging deformation and, consequently, the posture of the housing can be corrected.

Outer edges of the housing preferably are beveled over the entire periphery. Portions of the projections preferably comprise bevels that are wider and/or more moderately inclined than the other outer edges.

At least one projection preferably is arranged on a widthwise side of the housing to be inserted first into a panel in the inserting direction and is formed with an end inclined outwardly and away from the widthwise center of the housing.

A movable member preferably is provided on one of the housings and can interact with a mating member on the other of the housings to display a cam action upon displacement of the movable member. The cam action can perform or assist in connection and/or separation of the housings.

The invention also relates to a set of the above-described connectors. The shape and/or arrangement of the projections on the respective housings differ from one to another so that the respective housings are structurally distinguishable from each other.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
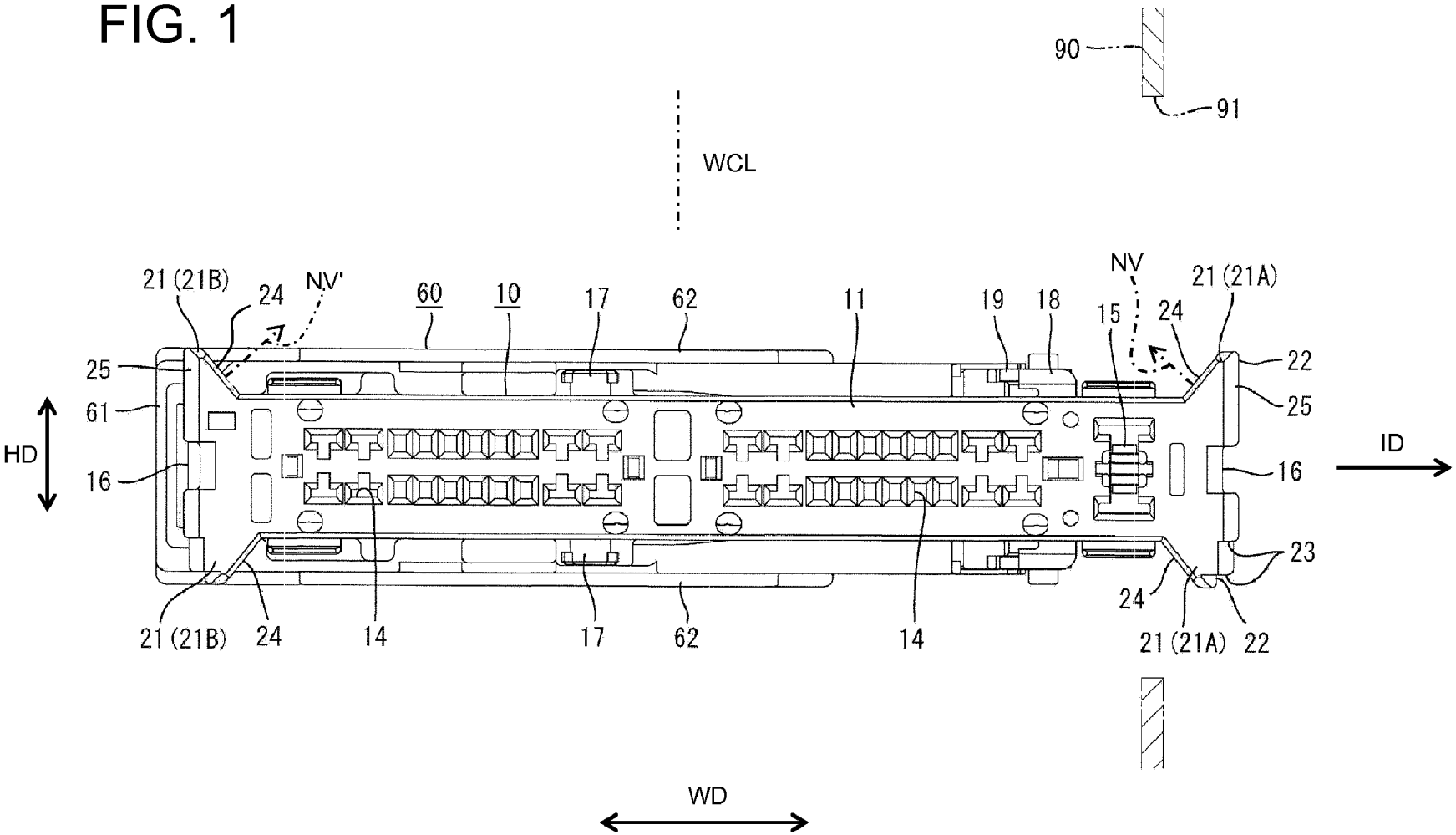
FIG. 1 is a front view showing a state where a connector according to the invention is inserted into a through hole of a panel.
Figure 2:
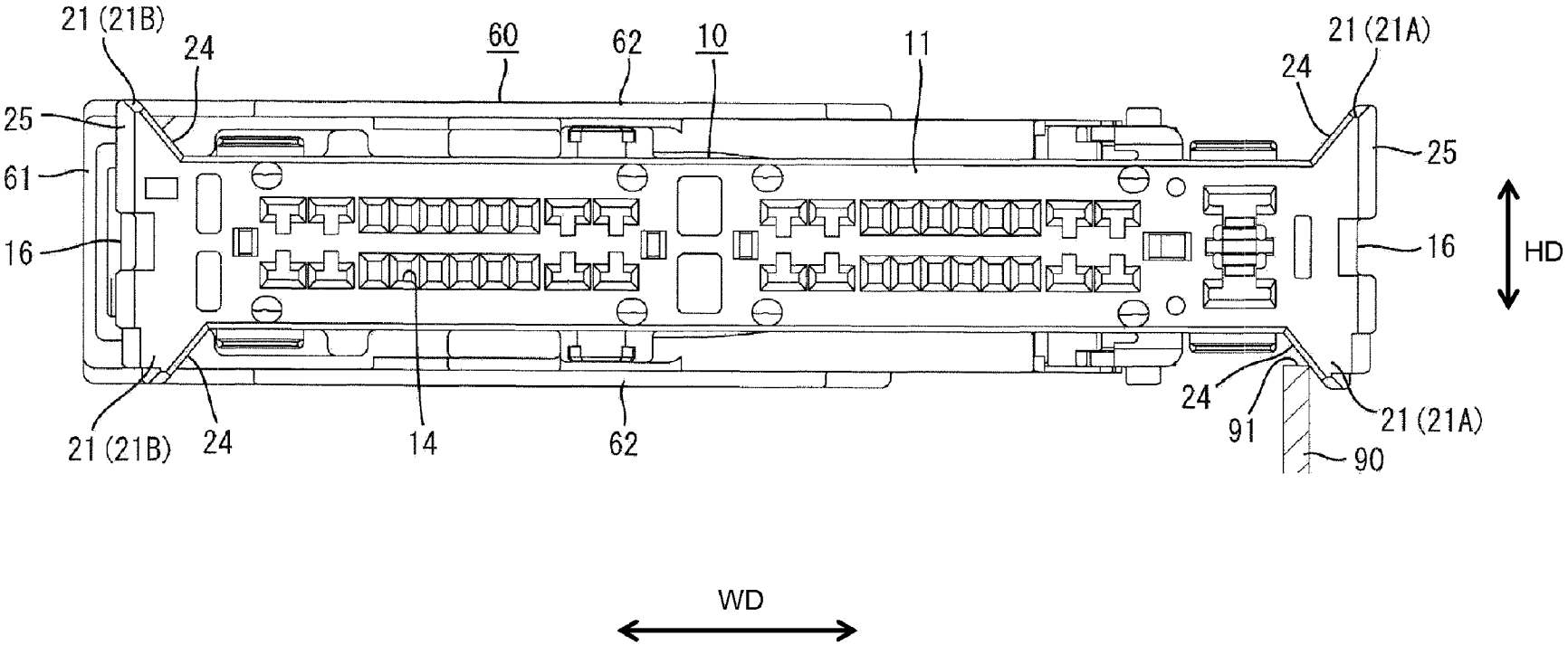
FIG. 2 is a front view showing a state where the connector is pulled out from the through hole.
Figure 3:
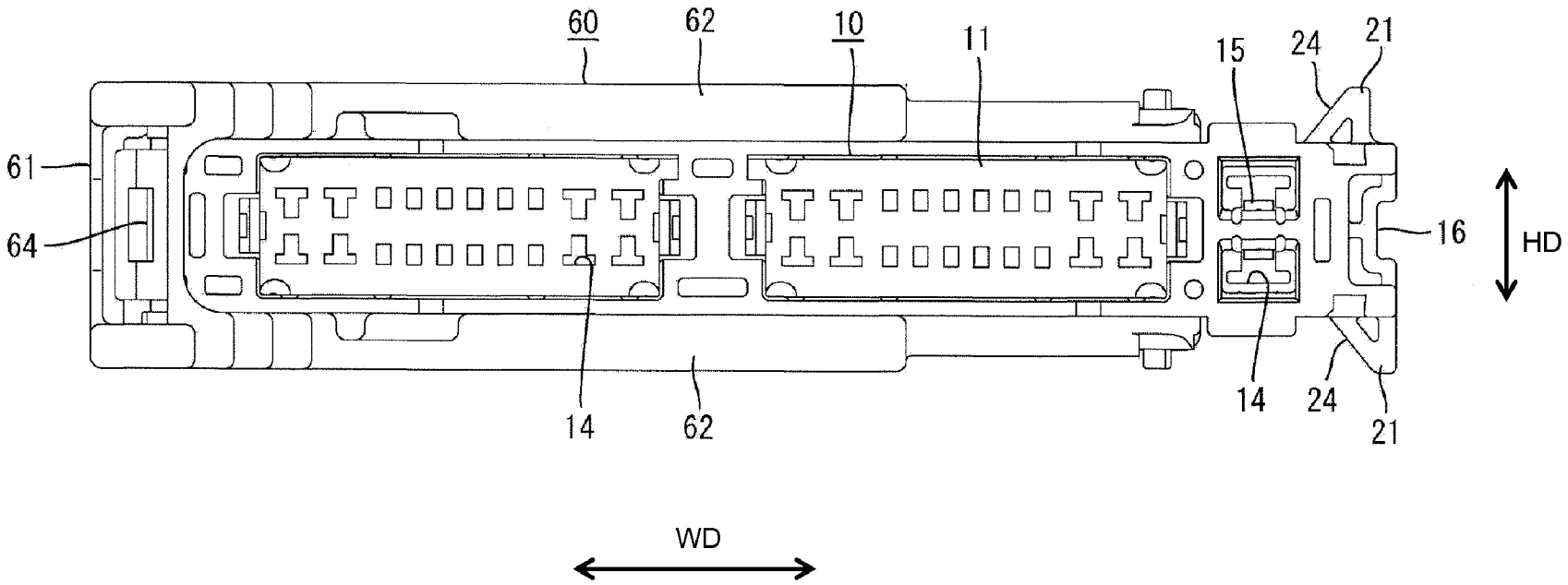
FIG. 3 is a rear view of the connector.

An embodiment of the invention is described with reference to FIGS. 1 to 10. A connector of this embodiment has a housing 10, a lever 60 and unillustrated terminal fittings. The housing 10 is connectable with a mating housing 40 along a connecting direction CD. Several different housings 10 and different mating housings 40 are prepared in conformity with different circuit patterns. Ends of the two housings 10, 40 to be connected are referred to as front ends concerning forward and backward directions FBD.

Figure 4:
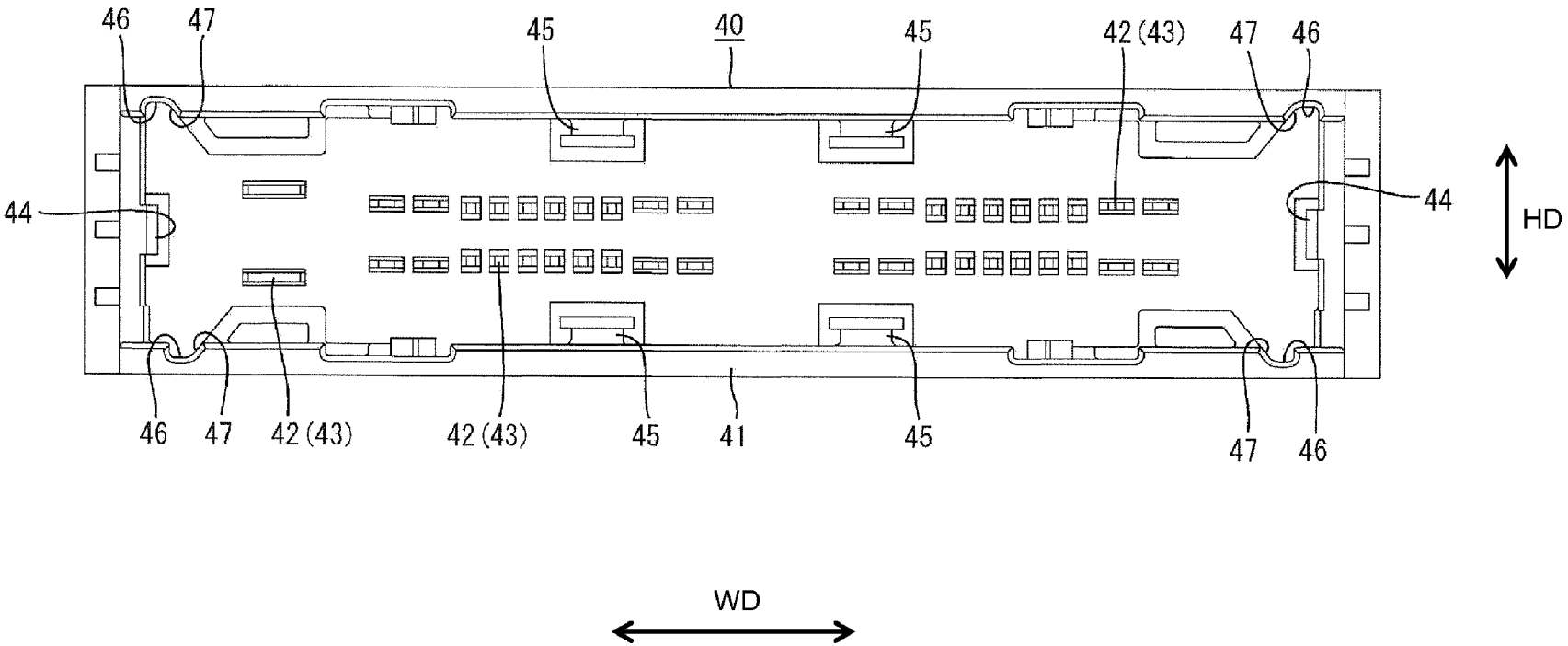
FIG. 4 is a front view of a mating housing.
Figure 6:
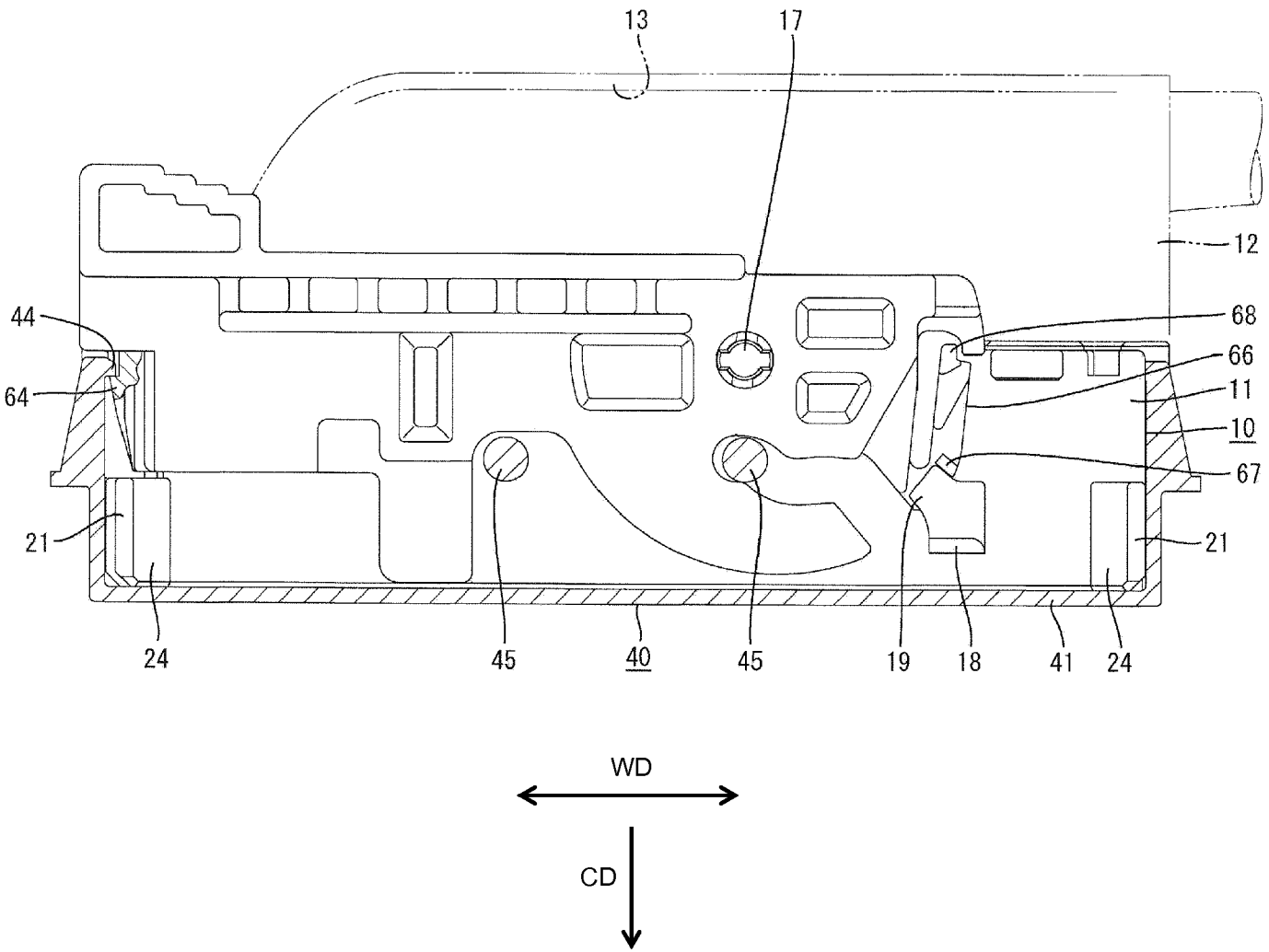
FIG. 6 is a plan view of the connector in which the lever is held at a connection position and which is properly connected with the mating housing.
Figure 7:
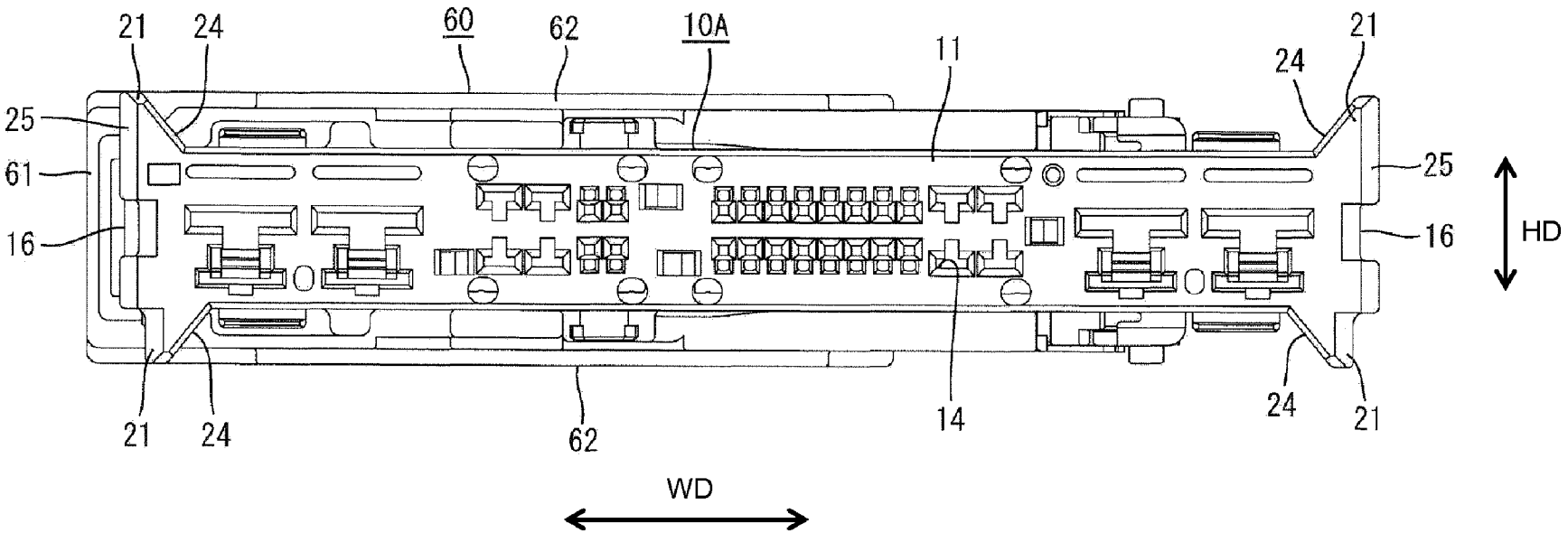
FIG. 7 is a front view of another housing.
Figure 8:
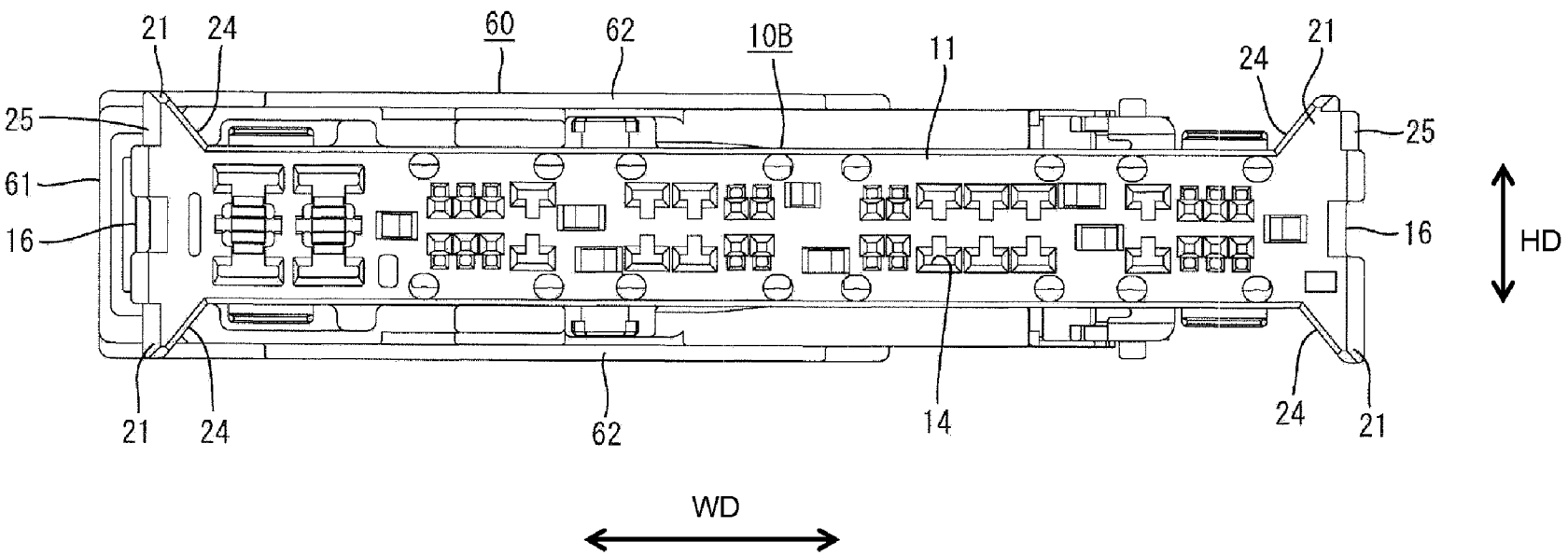
FIG. 8 is a front view of still another housing.
Figure 9:
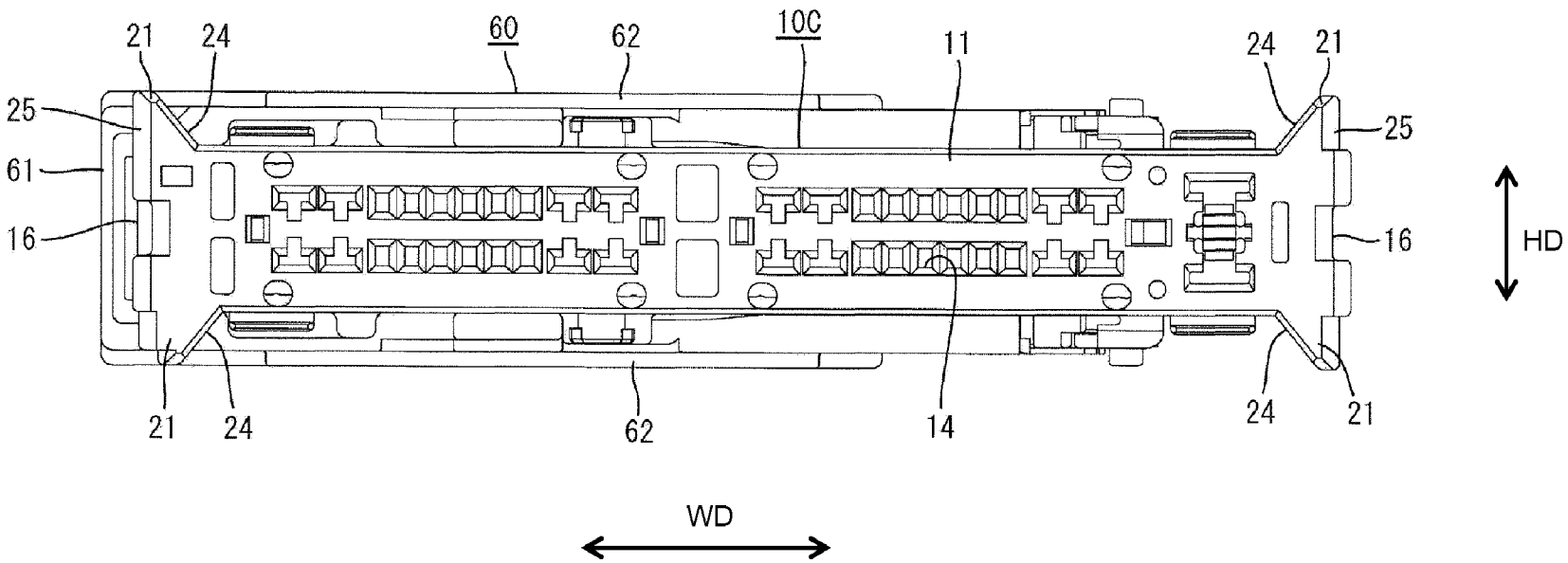
FIG. 9 is a front view of a further housing.

The mating housing 40 is made e.g. of synthetic resin and has a substantially rectangular tubular receptacle 41 that is wide in a width direction WD, as shown in FIGS. 4 and 6, and is narrow in a height direction HD that is orthogonal to both the width direction WD and the connecting direction CD. Mating terminal fittings 42 are mounted in a specified array in the back wall of the receptacle 41 in accordance with the respective circuit pattern and tabs 43 of mating terminal fittings 42 project into the receptacle 41. The mating terminal fittings 42 are of different dimensions in accordance with requirements of the respective circuit.

Engaging claws 44 project from the inner surfaces of opposite left and right walls of the receptacle 41 and are at intermediate positions with respect to the height direction HD. Leading ends of the engaging claws 44 are at an opening edge of the receptacle 41.

Left and right substantially cylindrical cam followers 45 are formed at positions close to a widthwise center of the inner surfaces of the opposite upper and lower walls of the receptacle 41. Further, recesses 46 are formed at positions near the four corners in the inner surfaces of the opposite upper and lower walls of the receptacle 41. Inwardly inclined mating inclined surfaces 47 are formed on inner surfaces of the recesses 46 facing toward a widthwise center of the receptacle 41. The mating inclined surfaces 47 are formed in common with all the types of mating housings 40. The mating inclined surfaces 47 are thickened within their inclinations to increase the strength of the receptacle 41. In other words, the inclined surfaces 47 have a variable thickness or strength that increases/decreases along their extension toward the distal or outer end thereof. The overall shape and/or arrangement of the respective recesses 46 differ for each type of the mating housing 40.

The housing 10 is made e.g. of synthetic resin and has a rectangular block-shaped housing main body 11 that is wide in the width direction WD and narrow in the height direction HD. A cover 12 is mounted on the housing main body 11 and covers the rear surface of the housing main body 11. The cover 12 is in the form of a cap that is open at the front and at one widthwise side. The cover 12 has a rear plate 13 in opposed spaced relationship to the rear surface of the housing main body 11.

Cavities 14 extend in forward and backward directions FBD through the housing main body 11, as shown in FIG. 1, and terminal fittings are inserted into the respective cavities 14 from behind. Locking lances 15 are formed at inner surfaces of the respective cavities 14 to lock the properly inserted terminal fittings. The terminal fittings particularly are of types to correspond to the mating terminal fittings 42. Each terminal fitting has a tubular part that can receive and connect to the tab 43 of the mating terminal fitting 42. Each terminal fitting also has a part to be connected with an end of an unillustrated wire. The respective wires are pulled out from the rear surface of the housing 10, bent substantially along the rear plate 13 of the cover 12 and drawn to the outside through the opening on the one widthwise side of the cover 12.

Engaging grooves 16 are formed in the opposite left and right outer side surfaces of the housing main body 11 at intermediate positions with respect to the height direction HD. The engaging grooves 16 extend in forward and backward directions FBD and the mating engaging claws 44 can slide on surfaces of the engaging grooves 16 to guide the connection of the two housings 10, 40.

Figure 5:
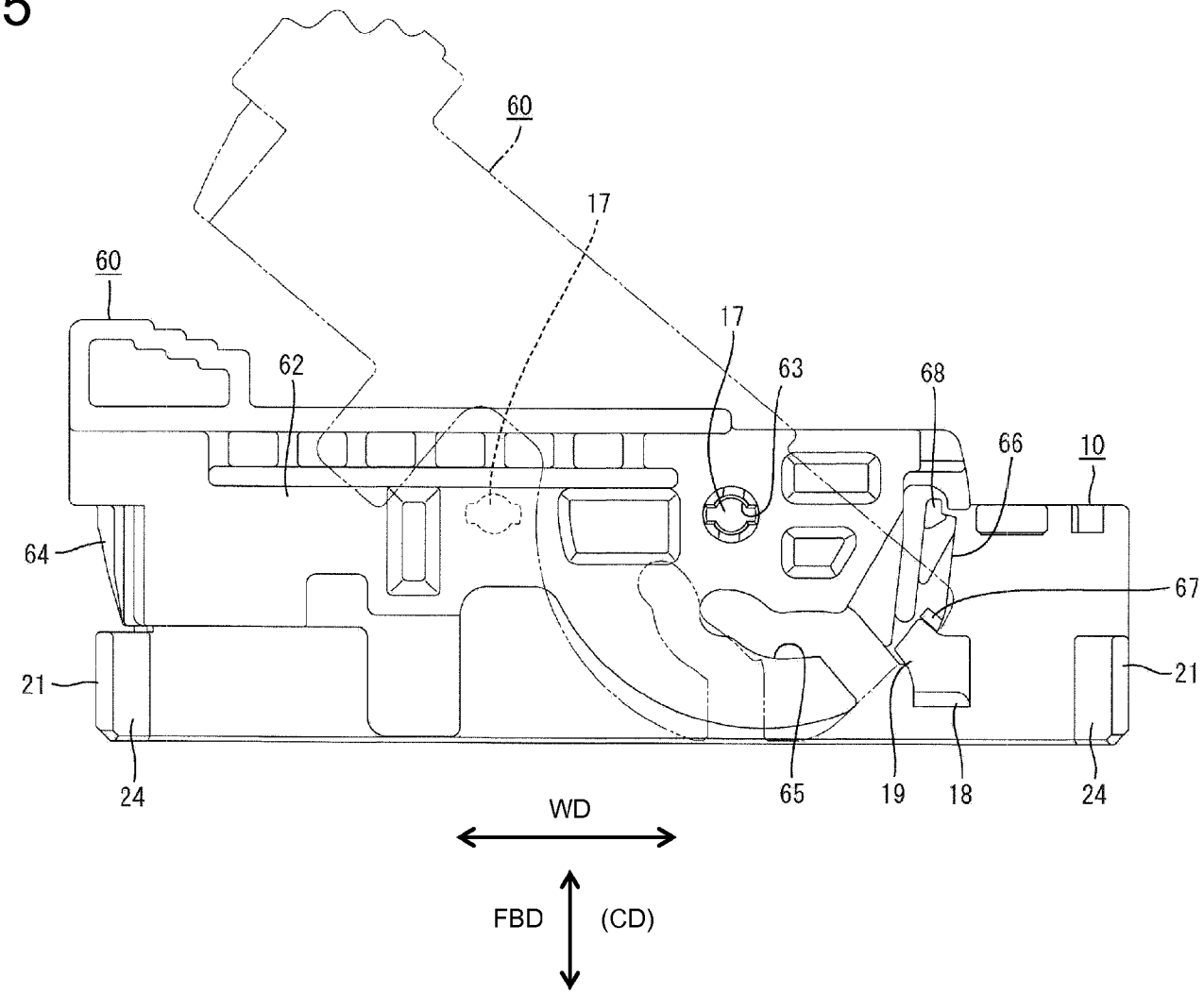
FIG. 5 is a plan view of the connector with a lever is held at a standby position.

Substantially cylindrical supporting shafts 17 are formed at rear positions of each of the opposite upper and lower surfaces of the housing main body 11, as shown in FIG. 5. The lever 60 is mounted selectively on one of the left pair and the right pair of supporting shafts 17 depending on the layout of the connector. An engaging portion 18 is formed at a position near one widthwise side of a front end portion of each of the upper and lower surfaces of the housing main body 11. Each engaging portion 18 includes a projecting piece 19 arranged at a short distance from and in parallel with the corresponding upper or lower surface of the housing main body 11.

The lever 60 is made e.g. of synthetic resin and has a coupling 61 that extends substantially in the height direction HD. Two parallel plate-shaped arms 62 project from opposite ends of the coupling 61 and bearings 63 penetrate through the arms 62 for receiving the respective supporting shafts 63. A resiliently deformable lock 64 is formed on the coupling 61. The lever 60 is rotatable about the supporting shafts 17 between a standby position and a connection position with respect to the housing 10. The coupling 61 is behind the rear plate 13 of the cover 12 at the standby position and is on one of the widthwise sides of the housing 10 at the connection position. Further, the lock 64 resiliently engages the mating engaging claw 44 at the connection position to hold the two housings 10, 40 together.

Each arm 62 has a cam groove 65 that opens at an outer peripheral edge. The cam followers 45 enter the cam grooves 65 when connecting the two housings 10, 40. The cam followers 45 then slide on surfaces of the cam grooves 65 as the lever 60 is rotated toward the connection position to exhibit a cam action. Thus, the two housings 10, 40 are connected with a small connecting force.

A part of an outer peripheral edge of each arm 62 is cut off to form the resilient locking piece 66. The resilient locking piece 66 extends along the outer peripheral edge of the arm 62 between the housing main body 11 and the engaging portion 18 and is resiliently deformable in a plate surface direction of the arm 62 with its base end as a support. A base end locking projection 67 is formed on the outer surface of the base end of the resilient locking piece 66 for engaging the projecting piece 19 of the engaging portion 18 at the connection position to prevent movement of the lever 60 to the standby position. A leading end locking projection 68 is formed on the outer surface of a leading end of the resilient locking piece 66 for engaging the projecting piece 19 of the engaging portion 18 at the standby position to prevent movement of the lever 60 to the connection position.

Projections 21 are formed at the four corners of the housing main body 11 and can fit into the mating recesses 46. The projections 21 project in the height direction HD at the substantially opposite widthwise ends of the upper and lower surfaces of the housing main body 11. However, the shape and/or arrangement of the projections 21 differ for each of the types of housings 10. In the illustrated housing 10 of FIGS. 1 through 6, the projections 21 are symmetrical with respect to the widthwise center of the housing main body 11 on each of the upper and lower surfaces of the housing main body 11. Specifically, the projections 21 on the upper surface of the housing main body 11 include vertical surfaces 22 substantially flush with and continuous with the opposite left and right surfaces of the housing main body 11. The projections 21 on the lower surface of the housing main body 11 include vertical surfaces 22 continuous with the opposite left and right surfaces of the housing main body 11 via steps 23. The respective projections 21 extend in forward and backward directions FBD and have substantially identical triangular cross section over the entire lengths. Rear ends of the projections 21 are at positions substantially half the entire length of the housing main body 11, and the front ends of the arms 62 can fit into the mating recesses 46 and face the rear ends of the respective projections 21 (see FIG. 6) fit into the mating recesses 46.

Outwardly inclined surfaces 24 are defined on the respective projections 21 facing toward the widthwise center of the housing main body 11. The inclined surfaces 24 are arranged to face and contact the mating inclined surfaces 47 when connecting the two housings 10, 40. The inclined surfaces 24 are inclined in a way so that their imaginary normal vectors NV, NV' are inclined with respect to the height direction HD and the width direction WD to point toward a widthwise center line WCL of the housing 10 (see FIG. 1). These inclined surfaces 24 are formed in common with all the types of housings 10.

The outer edges of the housing main body 11 are beveled over substantially the entire periphery and the opposite widthwise end edges of the housing 10 define bevels 25 that are wider and incline more moderately than the other outer edges.

A series of housings comprising four types of housings 10A to 10D having different functions and/or applications (e.g. having different number, sizes and/or specifications of terminal fittings) shown in FIGS. 7 to 10 are prepared in addition to this housing 10 and the respective housings 10, 10A to 10D are structurally distinguishable from each other by differences in the shape and/or arrangement of the respective projections 21. In the housing 10D shown in FIG. 10, both projections 21 on one widthwise side of a housing main body 11 are formed with end inclined surfaces 28 that incline outwardly away from the widthwise center of the housing main body 11.

Next, functions of this embodiment are described. Note that the housings 10A to 10D conform to the mode of the housing 10 described below unless otherwise mentioned.

The connector of this embodiment is to be inserted into a through hole 91 in a panel 90 prior to connection with the mating housing 40, and is connected with the mating housing 40 at an exit side of the panel 90. In this case, the housing 10 is inserted in a specified posture (e.g. horizontal) into the through hole 91 with the width direction WD aligned with a plate thickness direction of the panel 90 (see FIG. 1).

The projections 21B located at a rear with respect to an inserting direction ID of the housing 10 into the through hole 91 include the inclined surfaces 24 extending along the inserting direction ID and the plane of the inclined surface 24 is arranged at an obtuse angle to the inserting direction ID (i.e. its normal vector NV' is at an acute angle). Thus, even if the projections 21B at the rear with respect to the inserting direction ID interfere with the edge of the through hole 91, the inclined surfaces 24 of the projections 21B slide on the edge of the though hole 91. Thus, the housing 10 can be pulled smoothly out toward the exit side of the panel 90 without being caught.

The projections 21A located at the front with respect to the inserting direction ID of the housing 10 into the through hole 91 include the inclined surfaces 24 extending along a direction opposite to the inserting direction ID. Thus, even if the projections 21A at the front with respect to the inserting direction ID interfere with the edge of the through hole 91 upon pulling out the housing 10 inserted into the through hole 91 in the direction opposite to the inserting direction ID, the inclined surfaces 24 of the projections 21A slide on the edge of the though hole 91. Thus, the housing 10 can be pulled smoothly out toward an entrance side of the panel 90 without being caught.

Figure 10:
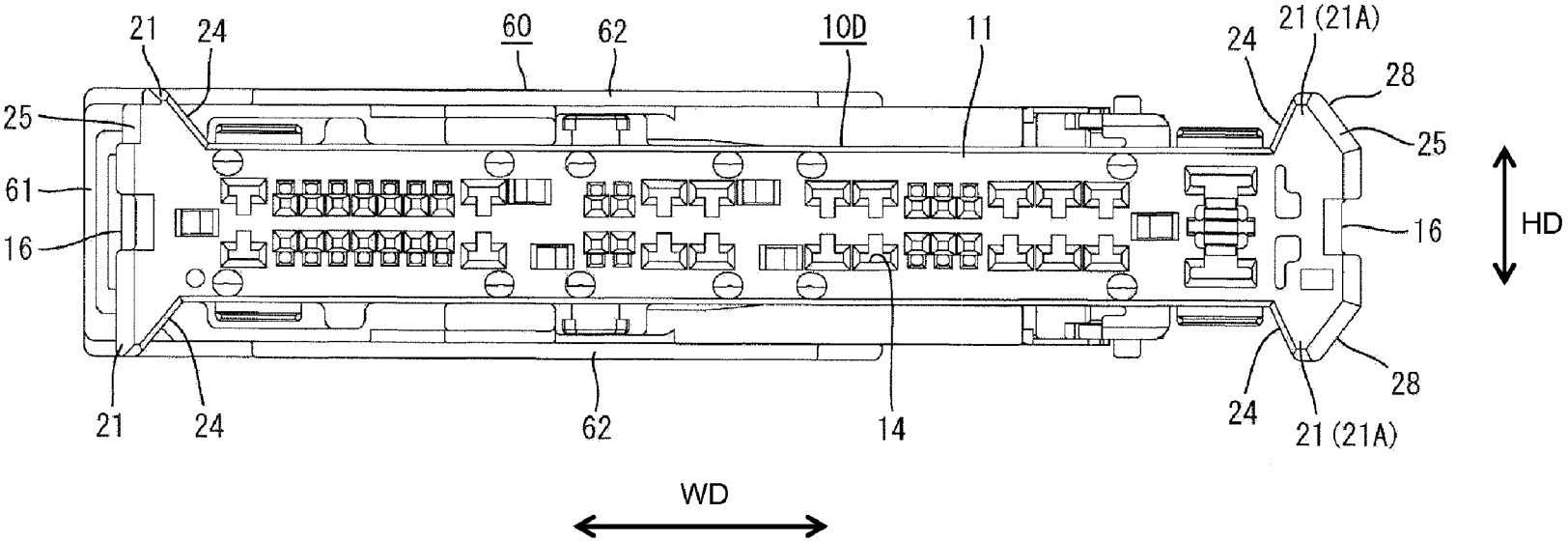
FIG. 10 is front view of still a further housing.

In the housing 10D shown in FIG. 10, the projections 21A at the front with respect to an inserting direction ID of the housing 10D into the through hole 91 include the end inclined surfaces 28 extending along the inserting direction ID or the plane of the end inclined surface 28 is arranged at an obtuse angle with respect to the inserting direction ID. Thus, even if the projections 21A at the front with respect to the inserting direction ID interfere with the edge of the through hole 91 when the housing 10D is inserted into the through hole 91, the end inclined surfaces 28 of the projections 21A slide on the edge of the through hole 91. Thus, the housing 10D can be inserted smoothly into the through hole 91 of the panel 90 without being caught.

The two housings 10, 40 then are connected at the exit side of the panel 90. Thus, the projections 21 fit into the corresponding recesses 46 if a combination of the two housings 10, 40 is correct and the connection of the housings 10, 40 progresses. The terminal fittings are connected electrically to proper depths when the housings 10, 40 are connected properly in this way.

On the other hand, the respective projections 21 cannot fit into the corresponding recesses 46 if the combination of the housings 10, 40 is incorrect and the connecting operation of the two housings 10, 40 is prevented. At this time, the respective projections 21 do not match or correspond to the facing recesses 46 in shape and/or arrangement. Therefore, the connection of the two housings 10, 40 in a wrong combination is avoided.

As described above, even if there is an obstacle, such as the panel 90 in the case of moving the housing 10 in the width direction WD, the obstacle slides on the inclined surfaces 24 of the projections 21 and the projections 21 do not catch the obstacle. Therefore, operability in moving the connector is improved.

Further, in the case of moving the housing 10 in the width direction WD and inserting it in the inserting direction ID into the through hole 91 of the panel 90, a movement of the housing 10 is guided smoothly at the time of inserting the housing 10 into the through hole 91 by the inclined surfaces 24 of the projections 21B at the rear with respect to the inserting direction ID of the housing 10 into the through hole 91. Thus, the inclined surfaces 24 of the projections 21A at the front with respect to the inserting direction ID of the housing 10 into the through hole 91 smoothly guide a movement of the housing 10 when pulling the housing 10 out of the through hole 91.

The projections 21 are formed at the four corners of the housing 10. Thus, reliability in preventing an erroneous connection of the two housings 10, 40 is improved and the strength of the housing 10 is increased.

Further, the recesses 46 are formed in the inner surfaces of the tubular receptacle 41 and include the mating inclined surfaces 47 corresponding to the inclined surfaces 24. Thus, parts of the receptacle 41 corresponding to the mating inclined surfaces 47 become thicker. Accordingly, the strength of the receptacle 41 around the recesses 46 is increased. As a result, engagement of the projections 21 with the recesses 46 will not cause a bulging deformation of the receptacle 41 even if the housing 10 is aligned obliquely to the mating housing 40 and connected with force. Consequently, the posture of the housing 10 can be corrected.

The invention is not limited to the above described and illustrated embodiment. For example, the following embodiments are also included in the scope of the invention.

The projection and the recess may be formed only at two corners on the opposite widthwise ends of the housing and the receptacle.

The projection and the recess may be formed only at two corner portions on one widthwise end and on the opposite ends in the height direction of the housing and the receptacle.

The projection and the recess may be formed only at one corner portion on one widthwise end and one end in the height direction of the housing and the receptacle.

The inclined surfaces may be curved or bent.

The invention also is applicable to connectors without a lever to perform or assist the connection and to connectors having a different type of movable member to perform or assist the connection, e.g. a slider that is linearly slidable or displaceable to display a cam action.

The present invention is not limited to the above mode of utilization and is suitably used also, for example, in the case of taking a connector out of its container box since operability in this take-out operation is improved by inclined surfaces of projections.

What is claimed is:

1. A connector comprising:

a housing having opposite front and rear ends spaced apart along a connecting direction, opposite left and right sides spaced apart in a width direction transverse to the connecting direction and opposite top and bottom surfaces, the front end of the housing being connectable with a mating housing along the connecting direction, and at least one projection formed at one of the left and right sides of the housing with respect to the width direction and projecting beyond one of the top and bottom surfaces at an angle to the connecting direction, a connecting operation of the two housings progressing when the projection is fit into a recess formed in the mating housing while being prevented if the projection is not fit into the recess, an inclined surface being formed on a side of the projection facing toward a widthwise center of the housing, the inclined surface inclining outwardly and intersecting one of the top and bottom surfaces at an obtuse angle so that the projection becomes gradually narrower in the width direction at positions farther from the top and bottom surfaces.

2. The connector of claim 1, wherein the at least one projection including the inclined surface comprises at least two projections formed at opposite left and right sides of the housing with respect to the width direction.

3. The connector of claim 2, wherein:

the at least two projections including the inclined surface comprises four projections formed respectively at opposite left and right sides of the bottom surface and at opposite left and right sides of the top surface.

4. The connector of claim 1, wherein the recess is formed in an inner surface of a tubular receptacle and includes at least one mating inclined surface corresponding to the inclined surface.

5. The connector of claim 1, wherein outer edges of the housing are beveled over substantially an entire periphery and wherein the projections comprise bevels wider or more moderately inclined than other outer edges.

6. The connector of claim 1, wherein at least one projection arranged on one widthwise side of the housing first inserted into a panel in an inserting direction has an end inclined surface inclined out away from the widthwise center of the housing.

7. A series of connectors comprising a plurality of the connectors of claim 1, wherein the respective housings are structurally distinguishable from each other by differences in the shape or arrangement of the respective projections.

8. A connector assembly, comprising:

a panel with a through hole;

a housing to be inserted into the through hole, the housing having opposite front and rear ends spaced apart along a connecting direction, opposite left and right sides spaced apart in a width direction transverse to the connecting direction and opposite top and bottom surfaces, at least one projection formed at one of the left and right sides of the housing with respect to the width direction and projecting beyond one of the top and bottom surfaces, an inclined surface being formed on a side of the projection facing toward a widthwise center of the housing, the inclined surface inclining outwardly and intersecting one of the top and bottom surfaces at an obtuse angle so that the projection becomes gradually narrower in the width direction at positions farther from the top and bottom surfaces; and a mating housing connectable with the housing along the connecting direction after the housing has been inserted into the through hole, at least one recess formed in the mating housing, a connecting operation of the housing and the mating housing progressing when the projection is fit into the recess in the mating housing while being prevented if the projection is not fit into the recess, wherein the inclined surface facilitates insertion of the housing into the through hole of the panel.

9. The connector assembly of claim 8, wherein the at least one projection including the inclined surface comprises at least two projections formed at opposite left and right sides of the housing with respect to the width direction.

10. The connector assembly of claim 9, wherein:

the at least two projections including the inclined surface comprises four projections formed respectively at opposite left and right sides of the bottom surface and at opposite left and right sides of the top surface.

11. The connector assembly of claim 10, wherein the mating connector has a tubular receptacle, a recess being formed in an inner surface of the tubular receptacle, the recess including at least one mating inclined surface corresponding to the inclined surface.

12. The connector of claim 8, wherein a movable member is provided on one of the housings and can interact with at least one mating member provided on the other of the housings to display upon displacement of the movable member a cam action that can perform or assist connection and separation of the housings.

* * * * *